United States Patent [19]

MacLarty

[11] Patent Number: 4,597,508

[45] Date of Patent: Jul. 1, 1986

[54] COMBINED CLOSURE AND POURING SPOUT

[75] Inventor: Bernard G. MacLarty, Germiston, South Africa

[73] Assignee: Van Leer S.A. (Proprietary) Limited, Parktown, South Africa

[21] Appl. No.: 625,019

[22] Filed: Jun. 27, 1984

[30] Foreign Application Priority Data

Jun. 27, 1983 [ZA] South Africa ..... 83/4687

[51] Int. Cl.[4] ..... B67B 7/24

[52] U.S. Cl. ..... 222/83; 222/538; 222/541; 222/543; 222/522

[58] Field of Search ..... 222/526, 531, 532, 537–539, 222/541, 543, 522, 525, 80, 81, 83

[56] References Cited

U.S. PATENT DOCUMENTS

| | | | |
|---|---|---|---|
| 1,145,896 | 7/1915 | Hothersall | 222/522 |
| 2,772,037 | 11/1956 | Rieke | 222/541 |
| 2,774,523 | 12/1956 | Rieke | 222/538 |
| 2,919,057 | 12/1959 | Halpern | 222/522 |
| 3,118,288 | 1/1964 | Small | 222/83 |
| 3,834,597 | 9/1974 | Guala . | |
| 4,022,357 | 5/1977 | Dwinell | 222/537 |
| 4,311,259 | 1/1982 | Batiol | 222/525 |

*Primary Examiner*—H. Grant Skaggs

*Attorney, Agent, or Firm*—Ladas & Parry

[57] ABSTRACT

A combined closure and pouring spout is disclosed which includes a neck for fitting into the filling opening of a container and a pouring spout connected to the neck by an annular frangible diaphragm. The spout includes a sleeve and a conical wall. The sleeve extends into the neck to guide the spout during opening of the closure. A pull ring is provided which enables the spout to be pulled through the neck to break the diaphragm. Elements are deformed by the neck as the spout is pulled through it and thereafter engage a neck surface to prevent the spout returning to its initial position. For pouring purposes the spout is pulled further through the neck to a position in which a sealing face thereof engages the neck. Pouring occurs through an opening and air enters through an aperture and passage.

7 Claims, 5 Drawing Figures

COMBINED CLOSURE AND POURING SPOUT

This invention relates to a combined closure and pouring spout for a container.

According to the present invention there is provided a combined closure and pouring spout for a container, the combined closure and spout comprising a neck for fitting in a filling opening of a container, an elongate pouring spout connected to said neck by a frangible diaphragm, the spout having a transverse wall and a side wall, one end of the side wall of the spout being within the neck and the side wall extending away from the neck towards a free end thereof, said transverse wall lying outside said neck between said neck and said free end of the side wall.

The side wall can include a generally conical part and a sleeve, said transverse wall preferably closing the smaller diameter end of said conical part and the sleeve preferably extending beyond said transverse wall on the side thereof opposite to said conical part and into said neck, said diaphragm joining said sleeve to said neck.

Said sleeve preferably includes a portion which is co-axial with and lies radially outwardly of, the smaller diameter end of said conical part, the sleeve being connected to said conical part at a position between said transverse wall and said free end of the side wall.

There can be protruding pressure points on the spout which, when the spout is pulled in the direction which causes it to pass through the neck, bear on and perforate the diaphragm.

Said sleeve can have an external sealing surface which co-operates with an internal surface of said neck to seal between the neck and the spout after the spout has been pulled through the neck to an intermediate position.

Preferably the spout includes non-return elements on the external surface of said sleeve, said elements being formed by the neck as the spout is pulled through the neck and thereafter engaging the neck to prevent said spout being pushed back to its initial position.

At the free end of the side wall there can be a circumferentially extending external sealing surface which co-operates with an internal surface of the neck to seal between the spout and the neck when the spout has been pulled through the neck to the maximum possible extent.

The combined closure and pouring spout can further include a cap which closes the neck. The cap can include a rim which enters between said neck and said sleeve when the cap is applied after the spout has been pulled through the neck to break the diaphragm, said rim being in sealing engagement with both the neck and the sleeve.

For a better understanding of the present invention, and to show how the same may be carried into effect, reference will now be made, by way of example, to the accompanying drawings in which.

Figure 1:
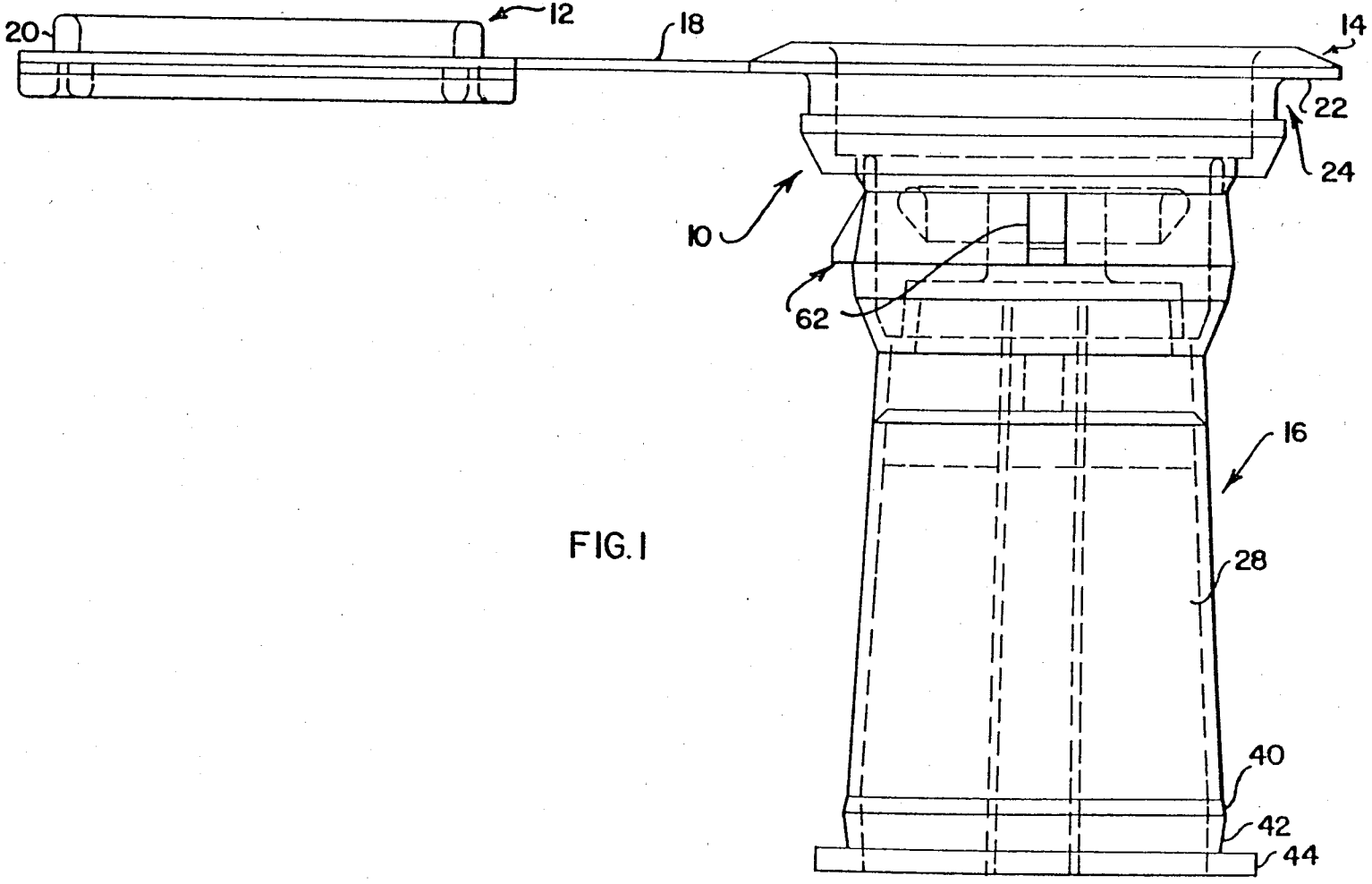
FIG. 1 is a side elevation of a combined closure and pouring spout for a container.

Referring firstly to FIG. 1, the combined closure and pouring spout for a container is designated 10 and comprises a cap 12, a neck 14 and a pouring spout 16. The cap 12 is joined to the periphery of the neck 14 by a flexible connecting strip 18. The cap 12 has a peripheral rim 20 which is a press fit in the neck 14.

Figure 2:
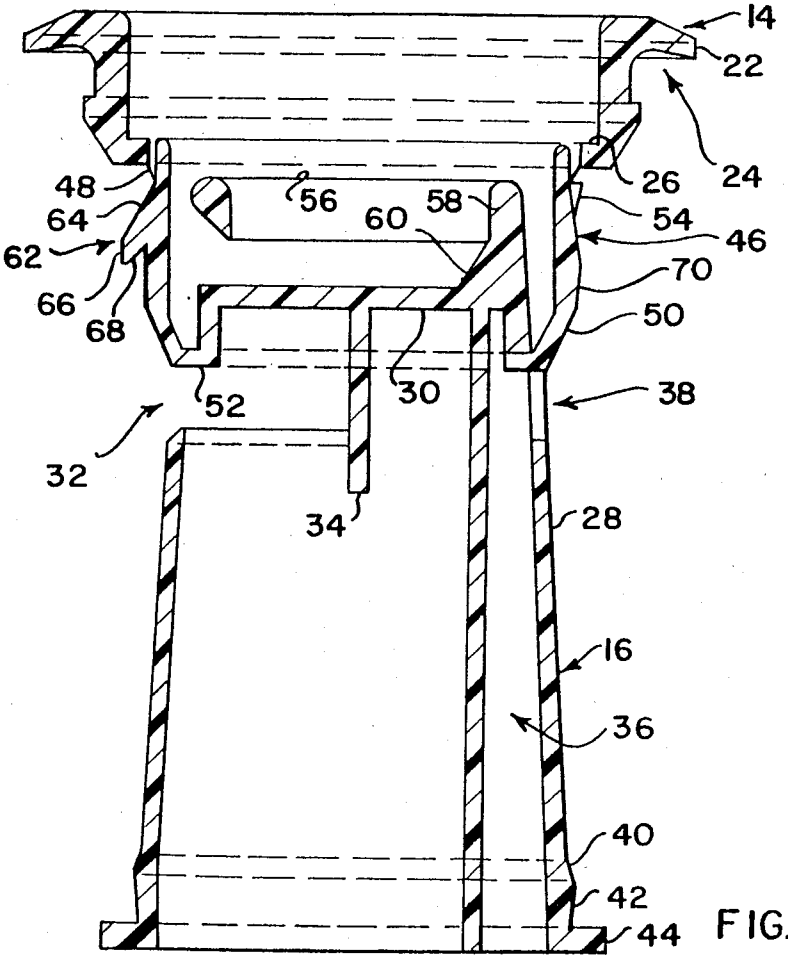
FIG. 2 is an axial section through the combined closure and pouring spout of FIG. 1 but with a cap thereof omitted.

The neck 14 includes a peripheral flange 22 and a circumferentially extending groove 24. Below the groove 24 the neck 14 tapers externally towards its lower end. At the end of the neck 14 remote from the flange 22 there is a radially inwardly directed flange 26 (see FIG. 2). The inner surface of the flange 26 is of frusto-conical form and tapers at, for example, 6°. Thus the upper end of the bore defined by the flange 26 is of greater diameter than the lower end of the bore defined by the flange.

The spout 16 comprises a generally frusto-conical side wall 28 the smaller diameter end of which is closed by a transverse wall 30. A circular outlet opening 32 is formed in the side wall 28 near the upper end thereof, and there is a partition 34 which extends downwardly from the underside of the transverse wall 30. The partition 34 extends to a level below the lower edge of the opening 32. The partition 34 is optional and can be omitted if desired.

Moulded integrally with the side wall 28 is a passage designated 36, the passage being open at each end. As will clearly be seen from FIG. 2, the upper end of the passage 36 communicates with the exterior of the spout 16 through an aperture 38.

The side wall 28 increases steadily in diameter over the major part of its length. Near the lower end of the side wall 28 there is a more steeply inclined circumferentially extending face 40. The face 40 itself intersects a further face 42 which tapers at, for example, 6° and in the opposite direction to the face 40. The face 42 intersects a radially outwardly directed flange 44. It will be understood that the side wall 28 is thicker at the junction between the faces 40, 42 than it is where the face 42 intersects the flange 44. The face 42 serves for sealing purposes as will be described in more detail hereinafter.

The spout 16 further includes a generally cylindrical sleeve 46. The upper end of the sleeve 46 lies within the bore defined by the flange 26 and is connected to the neck 14 by way of a circumferentially extending frangible diaphragm 48. It will be noted that the diaphragm joins the lower edge of the neck 14 to the sleeve 46 at a point which is below the upper edge of the sleeve 46. The diaphragm 48 is of frusto-conical form.

The lower end of the sleeve 46 is in the form of a tapering portion 50, the smaller diameter lower end of which is joined by a radially extending part 52 to the side wall 28. It will be noted that the transverse wall 30 lies above the level of the part 52 and is within the sleeve 46.

Protruding pressure points in the form of serrations 54 (see FIGS. 2 and 3) are provided on the outer face of the sleeve 46. In the illustrated form, the serrations extend over an arc of approximately 30° but this can be considerably reduced if desired. These serrations lie immediately below the diaphragm 48.

Figure 3:
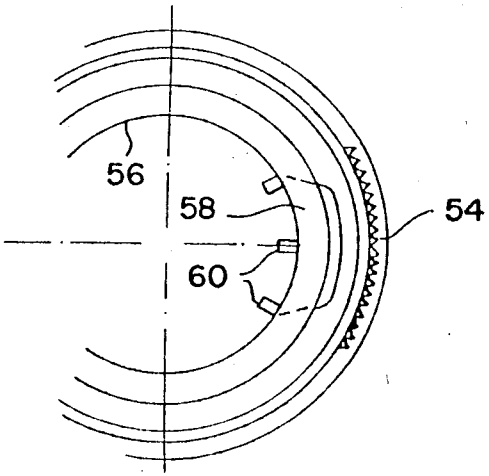
FIG. 3 illustrates a diaphragm tearing arrangement.

A pull ring 56 is connected by an arcuate support 58 to the top face of the transverse wall 30. Strengthening gussets 60 (three of which are shown in FIG. 3) are provided to strengthen the support 58 and prevent it tearing free of the wall 30 when the ring 56 is pulled, as will be described, to open the closure.

The sleeve 46 is formed externally with a number of circumferentially spaced protuberances 62. Such protuberances have an inclined face 64 merging with an axially extending face 66. The protuberances are undercut at 68.

The sleeve 46 also has a circumferentially extending sealing face designated 70. The sealing face 70 tapers at the same angle as the inner face of the flange 26, that is, 6° in the illustrated embodiment. The sealing face 70 is immediately below the undercuts 68 of the protuberances 62.

In use of the combined closure and pouring spout, the container to which it is to be fitted (usually a metal drum) is filled through the opening which is left in the top wall thereof. This opening is itself bounded by a rim which has some axial depth. The combined closure and pouring spout is inserted into the container through said filling opening with the flange 44 leading. The maximum diameters of the flange 44, side wall 28 and sleeve 46 are all smaller than the internal diameter of the rim around the opening so that they pass into the container without hinderance. The tapering external part of the neck 14 below the groove 24 engages said rim and the neck 14 is deformed by the rim as the combined closure and pouring spout is pressed into the filling opening. Such deformation results in the overall diameter of the neck 14 decreasing temporarily until the rim is clear of the tapering part of the neck whereupon the neck 14 springs open and the rim seats in the groove 24. The diaphragm is protected against damage during such inward collapse of the neck 14 as it is supported by the sleeve 46 against which it is pressed.

The inherent resilience of the synthetic plastics material of the combined closure and pouring spout ensures that leakage cannot occur round said rim. it will be understood that, at the time the combined closure and pouring spout is applied to the container, the cap 12 is in situ on the neck 14, the rim 20 of the cap 12 being pressed into the upper end of the neck 14.

When it is desired to open the container, the cap 12 is first pulled off the neck 14. To facilitate this, the cap 12 can be provided with one or more loops on the top surface thereof which the user can grip and pull. The cap, of course, remains attached to the neck 14 by means of the connecting strip 18 as shown in FIG. 1.

Figure 4:
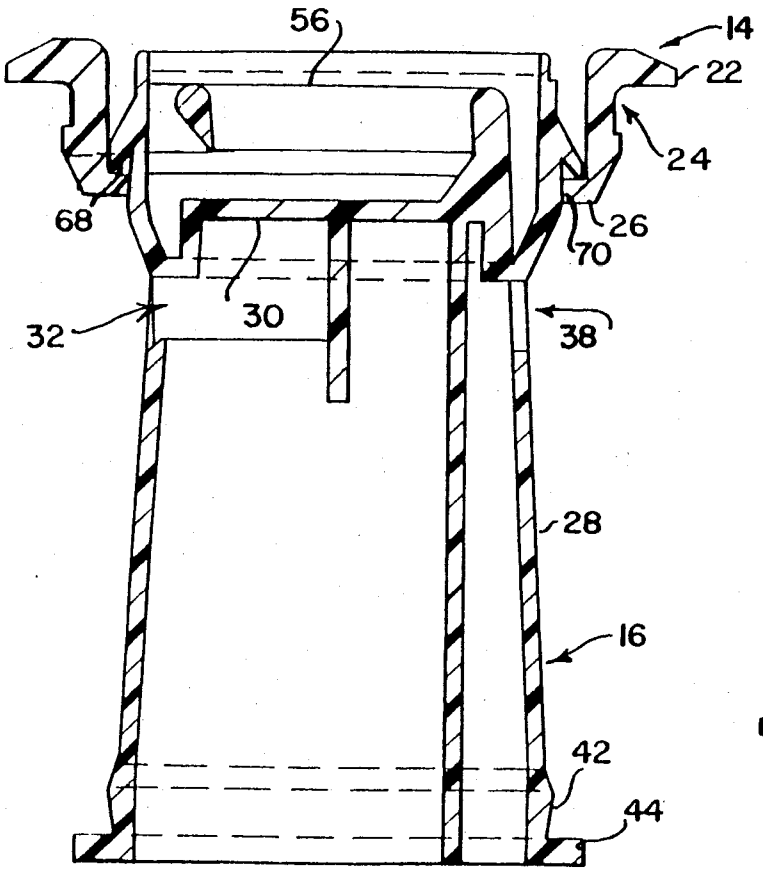
FIG. 4 is an axial section through the combined closure and pouring spout after the diaphragm thereof has been torn.

The ring 56 is then gripped and an upward pull exerted. Because the ring 56 is only connected to the remainder of the spout 16 by way of the support 58, there is a tendency for the entire spout to be pulled skew with respect to the neck 14. More specifically, as viewed in FIG. 2, it is the right hand side of the spout 16 which lifts with respect to the neck 14. This has the effect of bringing the serrations 54 into engagement with the underside of the diaphragm 48. The diaphragm, by this stage, has already become taut as a result of upward movement of the sleeve 46 inside the flange 26. The pressure points constituted by the tips of the serrations penetrate the diaphragm and initiate tearing. A constant pull on the ring 56 results in the diaphragm 48 tearing around its entire periphery, and such upward pull results in the protuberances 62 passing through the flange 26 to the position illustrated in FIG. 4. This is facilitated by the provision of the undercuts 68 which enable the protuberances 62 readily to collapse radially inwardly. From FIG. 4 it will be noted that the protuberances 62 engage the upper face of the flange 26 and that the tapering sealing face 70 of the sleeve 46 is in engagement with the face of the flange 26. The protuberances 62 prevent return movement of the spout 16 through the neck 14.

The arrangement of the wall 30 and the sleeve 46 are such that the wall 30 does not interfere with the inward collapse of the sleeve 46 which is necessary to facilitate passage of the sleeve 46 through the neck 14 after the diaphragm 48 has been torn. Furthermore, the fact that the sleeve 46 extends into the neck 14 results in the pourer 16 being guided by the neck 14 as soon as a pull is exerted on the ring 56.

Figure 5:
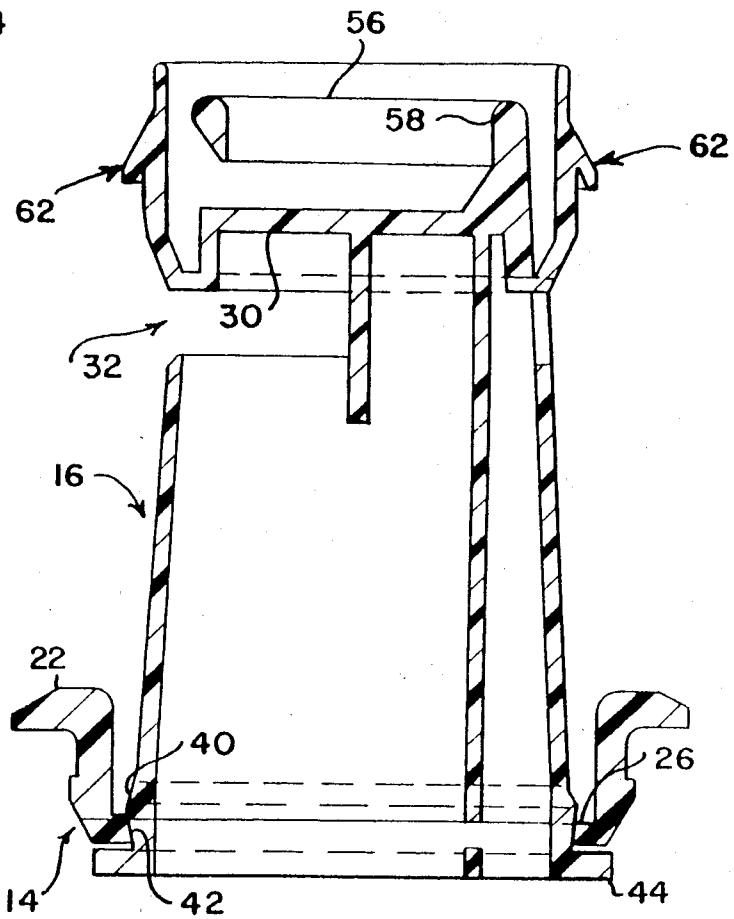
FIG. 5 is an axial section through the combined closure and pouring spout after the diaphragm thereof has been torn and the spout has been raised to a pouring position.

To pour liquid from the container, the spout 16 is pulled, again using the ring 56, through the neck 14 to the position illustrated in FIG. 5. As the spout 16 reaches its uppermost position, the face 40 slightly deforms the flange 26 until the intersection between the faces 40, 42 clears the flange 26 whereupon the radially inner face of the flange 26 and the face 42 come into sealing engagement with one another. This also serves positively to locate the spout 16 with respect to the neck. The flange 44 limits further upward movement of the spout 16 with respect to the neck 14.

When the container is tilted, liquid flows through the opening 32 and air enters via the aperture 38 and passage 36.

To reclose the container, the spout 16 is pushed back into the container through the neck 14 until the protuberances 62 re-engage the upper face of the flange 26. It will be noted from FIG. 4 that, at this stage, the upper edge of the sleeve 46 and the upper edge of the rim 22 lie at approximately the same level. When the cap 12 is pressed onto the neck 14, its rim 20 enters the annular gap between the flange 22 and the sleeve 46. Thus sealing occurs around the inner periphery of the rim 20 between itself and the sleeve 46 and around the outer periphery of the rim 20 between itself and the neck 14. Simultaneously, pressing the cap 12 onto the neck 14 has the effect of urging the sealing face 70 against the face of the flange 26. Thus, between the interior of the container and the exterior, there is a first seal at the region of the flange 26 and a second set of seals created by the cap 12 around the upper end of the sleeve 44. This double seal reduces the chances of leakage after the container has been used once but before it is emptied.

The spout 16 can be relatively thin walled so that, if desired, it can be collapsed inwardly by manual pressure while in the position shown in FIG. 5. This enables it to be removed entirely the from neck 14.

I claim:

1. A one-piece moulded closure and pouring spout for a container, the closure and spout comprising a sleeve-like neck for fitting in a filling opening of a container with an upper end portion outside of the container and a lower end portion inside the container, an elongate pouring spout having a sleeve-like side wall and a transverse wall, the spout being suspended from the lower end portion of said neck by a frangible diaphragm which is moulded integrally both with said neck and said side wall and which encircles said side wall, the spout having a minor upper portion which lies within said neck and a major lower portion which hangs down below said neck, said transverse wall and said side wall of the spout being moulded integrally with one another and said side wall lying within said major portion, and an outlet opening in said side wall between the end of the spout remote from said minor portion and said transverse wall.

2. A closure and spout as claimed in (any preceding) claim 1 wherein said spout includes protruding pressure points at a level below the diaphragm, said points, when the spout is pulled in the upward direction to cause it to pass through the neck, bear on and perforate the diaphragm.

3. A closure and spout as claimed in (any preceding) claim 1 wherein said side wall has a peripherally extending external sealing surface which co-operates with an internal surface of said neck to seal between the neck and the spout after the spout has been pulled through the neck to an intermediate position.

4. A closure and spout as claimed in claim 3, and further including a cap which closes the neck, the cap including a rim which enters an annular space between said neck and said spout when the cap is applied while the spout is in said intermediate position, said rim being in sealing engagement with the neck and the sleeve.

5. A closure and spout according to claim 1, and including non-return elements on the external surface of said spout said elements being deformed by the neck as the spout is pulled through the neck and thereafter engaging the neck to prevent said spout being pushed back to its initial position.

6. A closure and spout according to claim 4, in which, at the free end of the side wall, there is a circumferentially extending external sealing surface which co-operates with an internal surface of the neck to seal between the spout and the neck when the spout has been pulled through the neck to the maximum possible extent.

7. A closure and spout as claimed in claim 1, wherein the diaphragm is of frusto-conical form, the smaller, inner periphery thereof being below the larger, outer periphery thereof, the smaller inner periphery being integral with said spout and the larger outer periphery being integral with the lower edge of said neck, said spout extending upwardly within the diaphragm from the zone at which the diaphragm and spout join to a level above the bottom edge of said neck.

* * * * *